United States Patent [19]

Washbourne

[11] 4,036,324

[45] July 19, 1977

[54] NOISE REDUCTION

[75] Inventor: Colin Washbourne, Birmingham, England

[73] Assignee: Foseco International Limited, Birmingham, England

[21] Appl. No.: 600,474

[22] Filed: July 30, 1975

[30] Foreign Application Priority Data

Aug. 16, 1974 United Kingdom ..... 36234/74

[51] Int. Cl.[2] ..... F01N 1/04; F01N 7/18; F01N 3/06

[52] U.S. Cl. ..... 181/42; 181/36 D; 181/61

[58] Field of Search ..... 181/42, 36 D, 71, 61, 181/33 HB; 431/1

[56] References Cited

U.S. PATENT DOCUMENTS

| | | | |
|---|---|---|---|
| 1,909,511 | 5/1933 | Wilson | 181/42 |
| 1,968,456 | 7/1934 | Kliefoth | 181/42 |
| 2,583,366 | 1/1952 | Engels | 181/42 |
| 3,159,237 | 12/1964 | Thomas | 181/42 |
| 3,192,986 | 7/1965 | Haag | 181/36 D |
| 3,620,329 | 11/1971 | Wenzlaff | 181/33 HB |
| 3,638,756 | 2/1972 | Thiele | 181/61 |

*Primary Examiner*—Stephen J. Tomsky
*Attorney, Agent, or Firm*—Cushman, Darby & Cushman

[57] ABSTRACT

The noise from gas and oil burners can be reduced by using a burner quarl comprising a ceramic tube which is permeable or which has at least one permeable zone along its length, and which is surrounded along the permeable part by parts of the length of the tube by at least one sound absorbing chamber.

3 Claims, 3 Drawing Figures

NOISE REDUCTION

Figure 1:
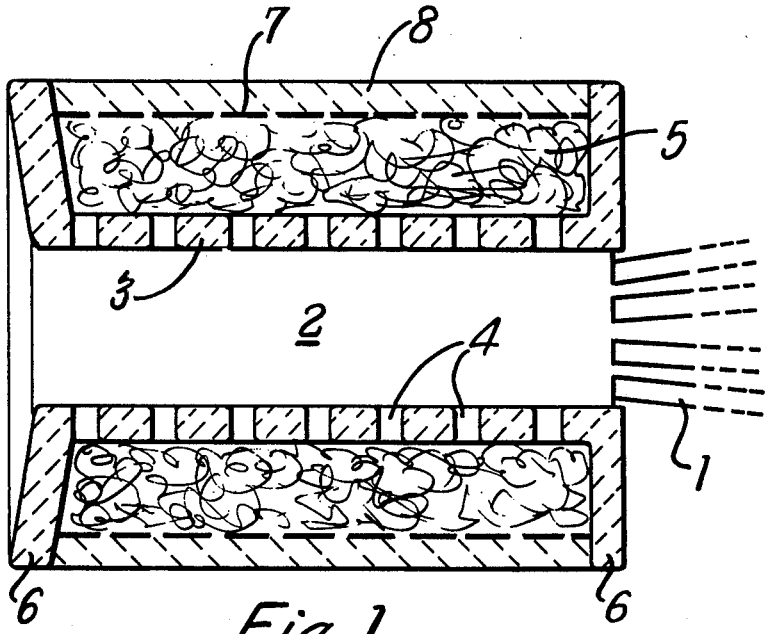

This invention relates to burner quarls for use in gas and oil burners, and to methods of reducing the noise emitted from such burners.

The noise emitted by gas and oil burning devices of the type of which air is supplied under pressure is well known. The causes of this are not yet fully understood, but among the mechanisms proposed are turbulence, the formation and decomposition of peroxides within the flame, and the resonant frequencies and their harmonics of various tubular elements associated with or contained in the burner assembly.

Many such burners, particularly those in industrial use, consist of a fuel-air proportioning jet which operates into a refractory tube down which the flame is directed, such a refractory tube being hereinafter referred to as a burner quarl. Often there is an annular space between the proportioning jet and the quarl, through which is inspired the so-called "secondary air" required to ensure complete combustion of the fuel. A great deal of noise is emitted from this annulus, but it is not the purpose of this application to propose means of suppressing it.

In certain burners, particularly those with a high rate of fuel consumption, the proportioning jet is sealed into the quarl, and all the air required for combustion is supplied via the jet. In such cases, virtually all the noise is emitted from the open end of the quarl.

According to the present invention there is provided a burner quarl comprising a ceramic tube which is permeable or which has at least one permeable zone along its length and which is surrounded along the permeable part or parts of the length of the tube by at least one sound-absorbing chamber.

According to a further feature of the present invention there is provided a method of reducing the noise emitted by a gas or oil burner which comprises directing the flame into a ceramic tube which is permeable or which has at least one permeable zone along its length, and which is surrounded along the permeable part or parts of the length of the tube by at least one sound-absorbing chamber.

The burner quarl tube may be constructed of a ceramic material having communicating porosity or of a substantially non-porous ceramic material provided with substantially radial vents at appropriate points along its length.

The ceramic material chosen in either case must obviously be of sufficient refractoriness for use in the position described.

Articles made of ceramic material having communicating porosity may be prepared according to the teachings of British Patent Specifications Nos. 1,388,911, 1,388,912 and 1,388,913 or may be made from any appropriate castable or rammable (can be formed to shape by ramming, capable of being rammed) refractory mix to which, before forming to shape, drying and firing ready for use, has been added volatile or combustible organic material in the form of particles or fibers, which during subsequent firing will disappear to leave a system of communicating spaces.

The substantially non-porous ceramic material referred to above may comprise any suitable casting or ramming grade refractory mix, a large number of which are available in commerce. The radial vents may be formed by drilling the final formed refractory tube, but are preferably formed by locating subsequently removable inserts between the inner and outer walls of the mould in which the tube is formed. Preferably the lips of these vents should be provided with smooth radiused edges where they enter the bore of the tube, to avoid causing additional turbulence of the as stream.

The vents may be located randomly along the length and around the circumference of the refractory tube. Alternatively, they may be located at the anti-nodes, or points of maximum pressure of the sound waves corresponding to the most objectionable sound frequencies emitted by the burner (commonly the fundamental frequency of the burner tube and the odd numbered harmonics thereof). In this case, each set of vents will lead into a separate chamber through a pipe formed in the thickness of the quarl wall, the volume and shape of the chamber and the length of the venting pipe being so adjusted as to resonate at the frequency whose suppression is sought and therefore to absorb it; in some instances it may be necessary to provide extra wall thickness of the quarl, or to affix an extra piece of tube by any appropriate means, to achieve the length of venting pipe needed for correct tuning.

In a preferred form of the invention, a porous refractory pipe is prepared in any of the ways described above. At each end of the pipe, either integral with the pipe or as separate pieces held in place by means of a suitable adhesive, are flanges, the diameter of which corresponds to the final outside diameter of the assembly. A loose refractory fibre blanket is then wound around the pipe, between the flanges, until the desired diameter is achieved, after which it is retained in place by any suitable means, e.g., a wrapping of stainless steel gauze clipped or welded into place. The two open ends of the pipe are then temporarily closed by two stoppers of plastics material or rubber, through at least one of which a vacuum can be applied to the bore of the pipe.

The whole assembly is then immersed in a ceramic fibre slurry containing a refractory bonding agent, and a vacuum applied until a sufficient thickness of outer fibre-ceramic shell is formed. Finally, the whole assembly is dried, and, if necessary, heated to a sufficient temperature to cure the refractory bonding agent.

Figure 2:
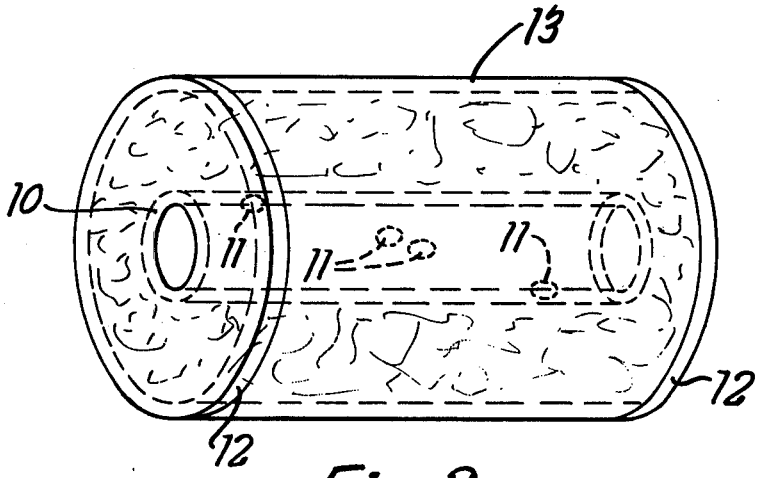
Figure 3:
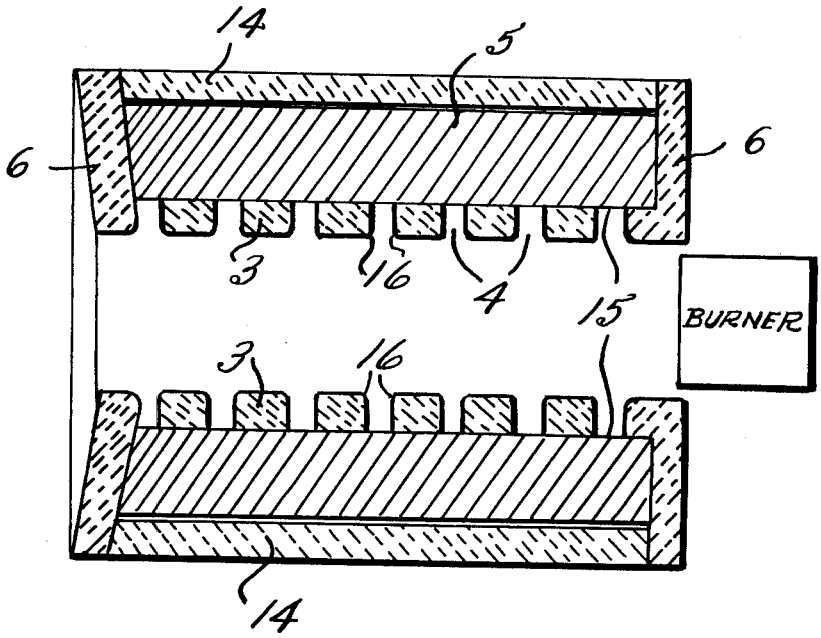

The invention is illustrated by way of example with reference to the accompanying drawings in which FIG. 1 shows a longitudinal section through a burner assembly according to the invention, and FIG. 2 shows a perspective view of an alternative burner assembly, and FIG. 3 shows a longitudinal sectional view of a modification of the burner assembly of FIG. 1.

Referring to FIG. 1, fuel and air are injected through a fuel-air proportioning jet 1, and the flame from 1 passes down the bore 2 of the quarl defined by walls 3 of non-porous ceramic material. Vents 4 are provided between the bore 2 and a fibre filled sound absorbing chamber 5. Flanges 6 are formed at the ends of the quarl to define the ends of chamber 5. On the outer wall of chamber 5 is a cylinder of stainless steel gauze 7 which acted as a filtration substrate during the formation of an outer refractory shell 8, which constitutes the outer wall of the quarl.

In a modification of the burner assembly shown in FIG. 1 the outer refractory shell 8 may be replaced by a preformed tube 14 of ceramic material, and the chamber 5 filled with loose sound absorbent material, for example, fibrous or particulate material or a mixture of the two. In this modification it may be desirable to place a tube 15 of metal gauze in contact with the outer surface of the walls 3, e.g., of metal alloy or stainless steel, as shown in FIG. 3. The lips of the vents 4 are radiused, as shown at 16 in FIG. 3.

Referring now to FIG. 2, this shows an alternative example of a quarl according to the present invention. The core 10 of the quarl of FIG. 2 was cast from a commercially available refractory-containing tabular alumina and calcium aluminate cement, having bore 57 mm, length 38 cm and wall thickness 22 mm. By means of removable plugs in the mould assembly, four 26 mm diameter holes 11 were formed through the thickness of the wall, two holes with their centres 75 mm from the opposite ends of the quarl and diametrically opposite one another, and the remaining two holes in the centre of the quarl and at 90° to the two outer holes.

The quarl was provided with flanges 12 at both ends supporting a cylindrical outer sleeve 13 of fibrous insulating refractory material concentric with the quarl core 10 and having an internal diameter of 26.7 cm, the whole space between the quarl core 10 and the sleeve 13 being filled with a fibrous reticular ceramic of the type described in U.S. Pat. No. 3,939,002 and having ten pores per linear inch. The outer surfaces of sleeve 13 and flanges 12 are sealed to prevent the egress of hot gases.

A comparison quarl was then prepared, identically but omitting the plugs from the mould assembly so that the wall of the core 10 was without holes.

A town gas/blown air burner having an output of 4 therms per hour was applied sealingly to the ends of the comparison and the experimental quarls in succession.

It was observed that the noise from the experimental quarl was much less than that from the comparison quarl and was also considerably less objectionable on account of its lower pitch, indicating that higher frequencies had been attenuated.

I claim as my invention:

1. A fluid fuel burner assembly comprising a burner, and a burner quarl consisting essentially of a substantially non-porous ceramic material tube having substantially radial vents along its length, the ceramic material tube being surrounded along at least part of its length by at least one sound absorbing chamber, and wherein the outside of the sound absorbing chamber comprises a surrounding wall of sealed ceramic material connected to the ceramic tube by two radial flanges.

2. The burner of claim 1 wherein the sound absorbing chamber is filled with a loose refractory fibre blanket.

3. The burner of claim 1, wherein the sound absorbing chamber is filled with a fibrous reticular ceramic material.

* * * * *